United States Patent [19]

Becker et al.

[11] Patent Number: 4,804,933

[45] Date of Patent: Feb. 14, 1989

[54] AUTOMATIC TRANSFER SWITCH

[75] Inventors: James A. Becker, Grafton; Lawrence F. Freitag, Bayside, both of Wis.; Frank W. Kussy, Randallstown, Md.

[73] Assignee: Brown Industrial Gas, Inc., Dallas, Tex.

[21] Appl. No.: 176,756

[22] Filed: Apr. 1, 1988

[51] Int. Cl.[4] ..... H01H 3/00

[52] U.S. Cl. ..... 335/186; 200/144 R; 200/147 R; 335/138; 335/140; 335/201; 335/11

[58] Field of Search ..... 200/144 R, 147 R, 10, 200/9; 335/190, 188, 186, 11, 16, 201, 195, 140, 138

[56] References Cited

U.S. PATENT DOCUMENTS

| | | | |
|---|---|---|---|
| 2,821,594 | 1/1958 | Latour | 335/195 |
| 2,944,129 | 7/1960 | Cole et al. | 335/16 |
| 3,092,699 | 6/1963 | Latour | 200/147 R |
| 3,435,390 | 3/1969 | Spinelli et al. | 335/161 |
| 3,555,471 | 1/1971 | Mitskevich et al. | 200/147 R |
| 3,593,227 | 7/1971 | Mitskevich et al. | 335/16 |
| 3,697,709 | 10/1972 | Witkor | 200/48 |
| 4,096,460 | 6/1978 | Gessinger et al. | 335/136 |
| 4,137,439 | 1/1979 | MacLean | 200/153 |
| 4,157,461 | 6/1979 | Wiktor | 200/18 |
| 4,255,733 | 3/1981 | MacLean | 335/190 |
| 4,295,053 | 10/1981 | Kovatch et al. | 307/64 |
| 4,295,054 | 10/1981 | Kovatch et al. | 307/80 |
| 4,388,535 | 6/1983 | Wiktor et al. | 307/113 |
| 4,405,867 | 9/1983 | Moakler et al. | 307/64 |
| 4,423,336 | 12/1983 | Iverson et al. | 307/64 |
| 4,430,579 | 2/1984 | Wiktor | 307/134 |

OTHER PUBLICATIONS

Page 1 from Automatic Switch Company document copyrighted in 1976.

Page 4 from catalog 1100 of the Automatic Switch Company copyrighted in 1982.

*Primary Examiner*—Robert S. Macon

*Attorney, Agent, or Firm*—Quarles & Brady

[57] ABSTRACT

An automatic electric load transfer switch incorporates an over-the-center spring mechanism to operate switch contacts. The spring mechanism has a first position at which the electric load is connected to one electricity source and a second position at which the load is connected to another electricity source. The spring mechanism is driven by a solenoid activated cam shaft. An apparatus is provided for halting the movement of the spring mechanism at a position intermediate the first and second positions at which the load is not connected to either electricity source. The halting apparatus is releasable so that the spring mechanism can continue its movement between the first and second positions.

14 Claims, 4 Drawing Sheets

AUTOMATIC TRANSFER SWITCH

The present invention relates to automatic transfer switches for connecting an electric load to either a normal power supply or an emergency power source.

BACKGROUND OF THE INVENTION

Many commercial and industrial buildings have a standby electrical generator which provides power in the event of a failure of the electricity from the utility company. Should a storm or another event interrupt the electrical power from the normal source, a control circuit detects the outage and starts the standby generator. When the generator has reached full speed and is generating the nominal output voltage, the control circuit activates an automatic transfer switch, such as shown in U.S. Pat. No. 4,157,461. The switch transfers the connection of selected emergency circuits within the building from the normal power supply lines to the output of the standby generator. These emergency circuits typically include minimal lighting throughout the building, elevators, computers, and other equipment which require power during the emergency.

Heretofore, such automatic transfer switches had two positions, one in which the emergency power source, such as the standby generator, was connected to the building circuits and the other position in which the lines from the utility company were connected to the building circuits. The switch typically did not provide a position at which neither power supply was connected to the building circuits. Therefore, if an electrician had to perform main tenance work on the building circuits, an additional shutoff switch had to be provided to disconnect those circuits from the automatic transfer switch so that neither power supply could be connected to the circuit while maintenance was being performed.

SUMMARY OF THE INVENTION

An automatic transfer switch includes at least one switch module for alternatively connecting an electric load to two sources of electricity. The switch module is connected to an over-the-center spring mechanism which mechanically causes the switch module to change the electrical connections. The over-the-center spring mechanism has a first position at which the load is connected to one of the sources of electricity and a second position at which the load is connected to the other source. A driving means is provided to move the over-the-center spring mechanism between the two positions. In the preferred embodiment, this means includes a first shaft having two cam wheels which engage the over-the-center spring mechanism to move it between the two positions. The first shaft also includes a ratchet wheel mechanism which is driven by either a solenoid or a manual operator handle coupled to a second shaft having an activator lever which engages the ratchet mechanism for the first shaft.

The switch is further provided with an apparatus for engaging the over-the-center spring mechanism to halt its movement between the first and second positions so that it assumes a third position at which the load is connected to neither source of electricity. A device is coupled to the halting apparatus to release its engagement with the over-the-center spring mechanism so as to permit the continued movement of the mechanism between the two positions.

An object of the present invention is to provide an automatic transfer switch with a center-off position at which the load coupled to the switch is connected to neither source of electricity.

Another object of the present invention is to provide an automatic transfer switch which is activated by an over-the-center spring mechanism which insures that the contacts of the switch are held in the proper state, either open or closed.

A further object of the present invention is to provide an automatic transfer switch which can be driven either electrically via a solenoid or manually by an operator handle. Such alternative driving mechanism being provided such that either driving means may activate the switch without interfering with the other driving means.

A still further object of the present invention is to provide an automatic transfer switch in which the switching operation between two different sources of electricity is normally halted at an off position unless and until a mechanism is activated so as to allow the switch to continue its operation.

DETAILED DESCRIPTION OF THE PRESENT INVENTION

Figure 1:
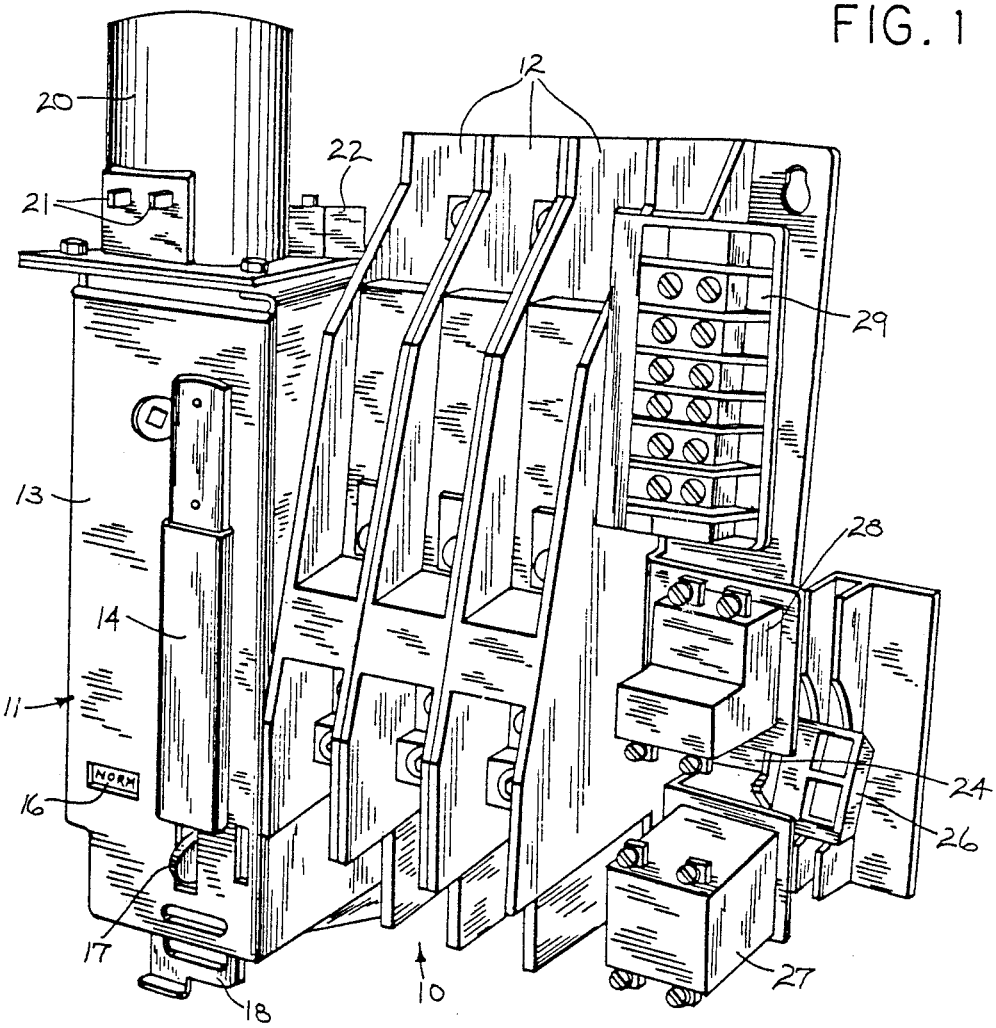
FIG. 1 is an isometric view of an automatic transfer switch according to the present invention.

With initial reference to FIG. 1, an automatic transfer switch, generally designated as 10, comprises an actuator assembly 11 and three switch modules 12. The actuator assembly 11 has a front cover 13 through which a manual operator handle 14 extends. The front cover 13 has an indicator window 15 through which can be seen a position indicator 16. The position indicator designates whether the automatic transfer switch is connecting the normal power supply or an emergency power supply to the electrical load circuits which connect to the switch 10. A center-off latch lever 17 extends through another aperture in the front cover 13 which is located just below the manual operator handle 14. A center-off lock lever 18 is seen partially extending from beneath the actuator assembly 11 behind the front cover 13 and, as will be described hereinafter, may be pushed upward to engage the center-off latch lever 17 preventing the latter lever's operation. In this upward position, a slotted aperture in the lock lever 18 is aligned with a similar aperture in the front cover 13 which enables a padlock to be placed through both apertures securing the position of the lock lever 18.

Mounted on the upper surface of the actuator assembly 11 is a primary solenoid 20 and a normally closed switch 22. The primary solenoid 20 is to be connected by terminals 21 in series with the switch 22 to a conventional control circuit (not shown) which energizes the solenoid to activate the automatic transfer switch. If the automatic transfer switch 10 is activated by the manual operator handle 14, the movement of the handle causes switch 22 to open thereby preventing the control circuit from simultaneously energizing the primary solenoid.

Figure 8:
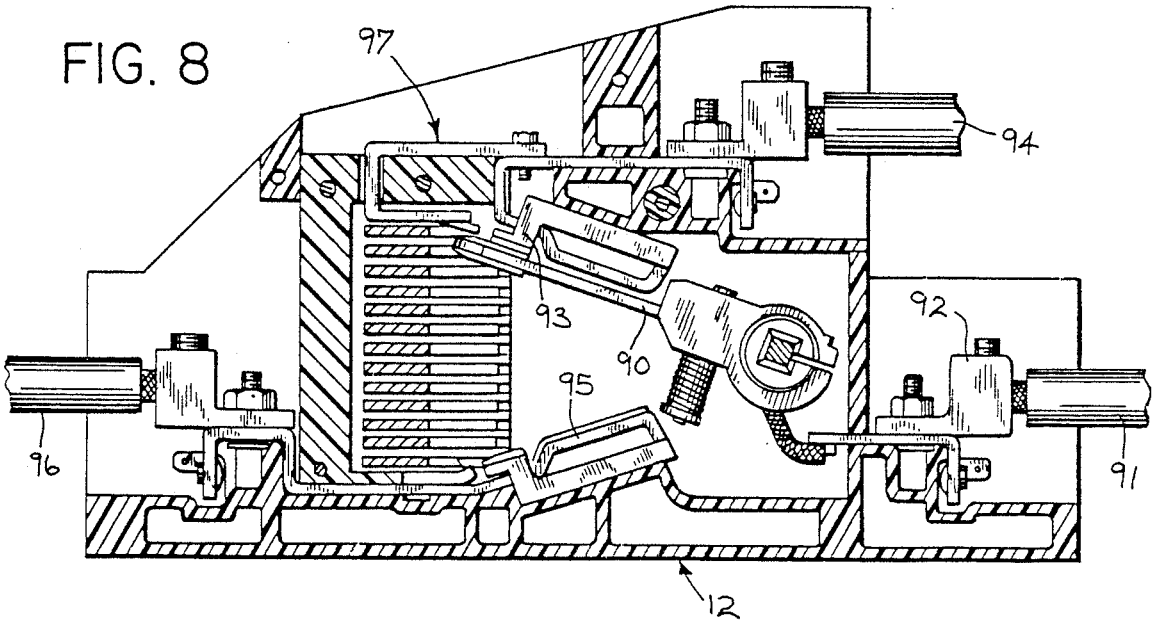
FIG. 8 is a cross section view of one of the switch modules shown in FIG. 1.

A switch drive shaft 24 extends from the actuator assembly 11 through the three switch modules 12 and is coupled to activate the switch mechanism within each module. Each of the three switch modules 12 includes a single-pole double-throw switch which connects one of the phase lines for the three-phase electrical service within a building to either one of the three-phase lines from a normal electrical supply, such as that provided by a utility company, or one of the three-phase lines from a standby emergency generator for the building. Although the present invention can be used with different switch module designs, the inner details of a switch module for the illustrated automatic transfer switch are shown in FIG. 8. A movable contact arm 90 is attached to the switch drive shaft 24 to pivot with the rotation of the shaft. One phase line 91 for the building circuits is connected to the contact arm by terminal 92. The contact arm is shown in a first position at which it is in electrical contact with a first fixed contact 93. The first fixed contact is electrically coupled to one of the phase lines 94 from a source of emergency power. When the contact arm 90 pivots counterclockwise from the illustrated position, it will contact a second fixed contact 95 which is electrically coupled to a phase line from a normal source of electricity. The switch module 12 also includes a conventional arc chute 97 to suppress any electric arcs created as the sets of contacts separate. The details of each of the switch modules are described in U.S. patent application Ser. No. 176,718 filed on even date herewith and entitled "Electric Switch with Counteracting Electro-Dynamic Forces."

The distal end of the switch drive shaft 24 extends from the rightmost switch module 12 and has a teeter bar 26 attached thereto. The teeter bar 26 has a cammed surface which alternately closes either of two position indicator switches 27 and 28. These indicator switches provide control signals to the transfer switch control circuit indicating the position of the transfer switch. A different one of these switches closes when the contact arm 90 is against the first or second fixed contacts 93 and 94 within the switch modules 12. A terminal block 29 is provided to make electrical connection between the control circuit and the various indicator switches 22, 27 and 28.

Figure 2:
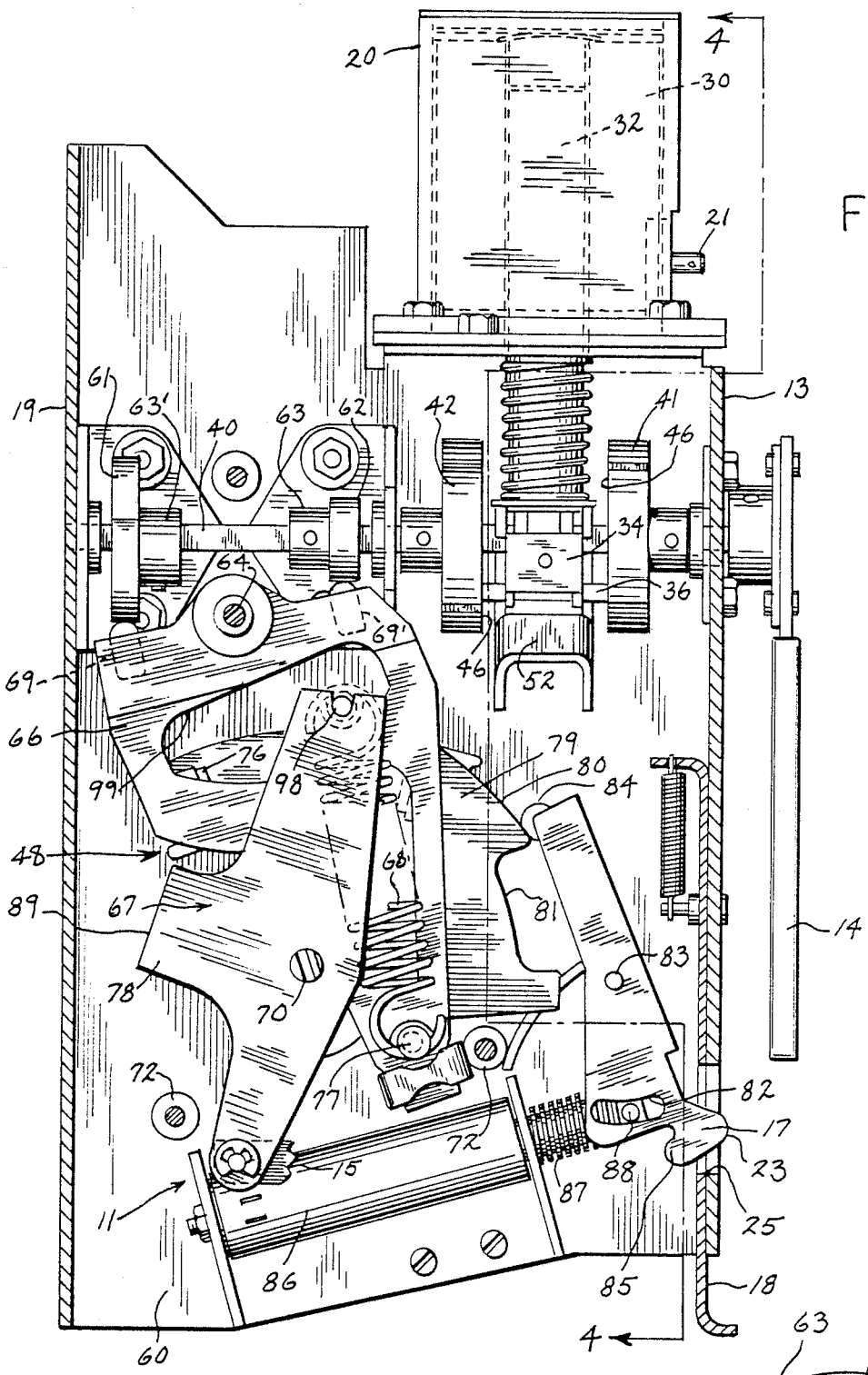
FIG. 2 is a plane view of the side of the mechanical actuator mechanism for the switch of FIG. 1.
Figure 3:
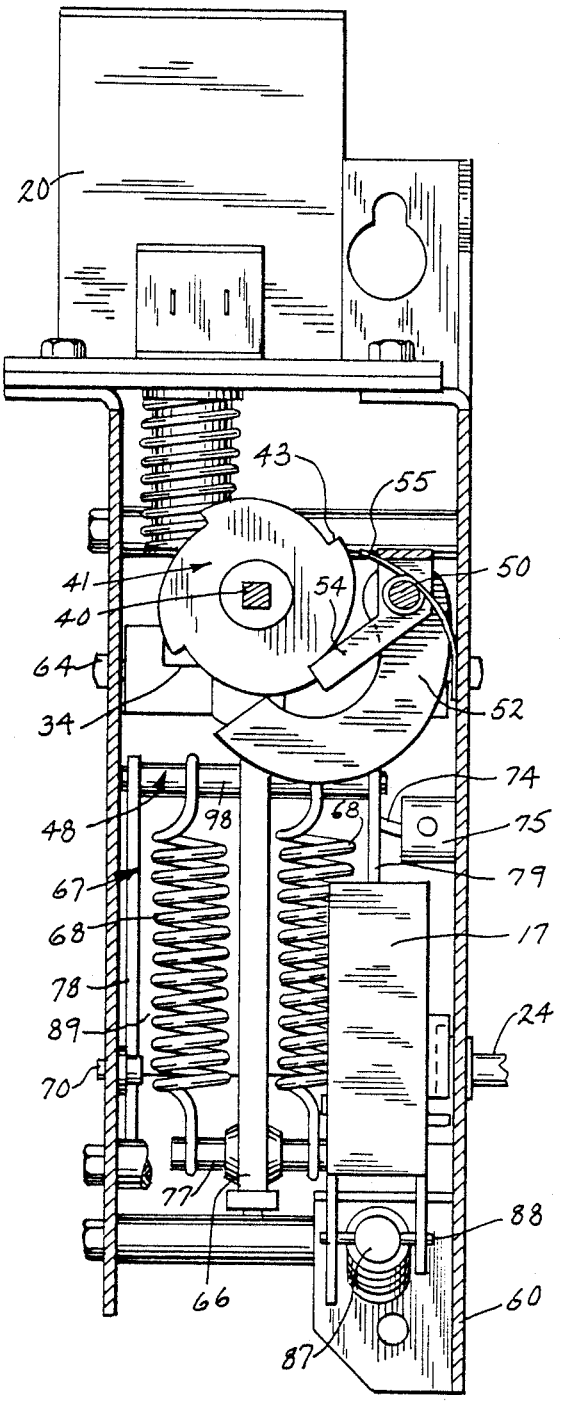
FIG. 3 is a plane view of the actuator mechanism with the front cover removed.
Figure 4:
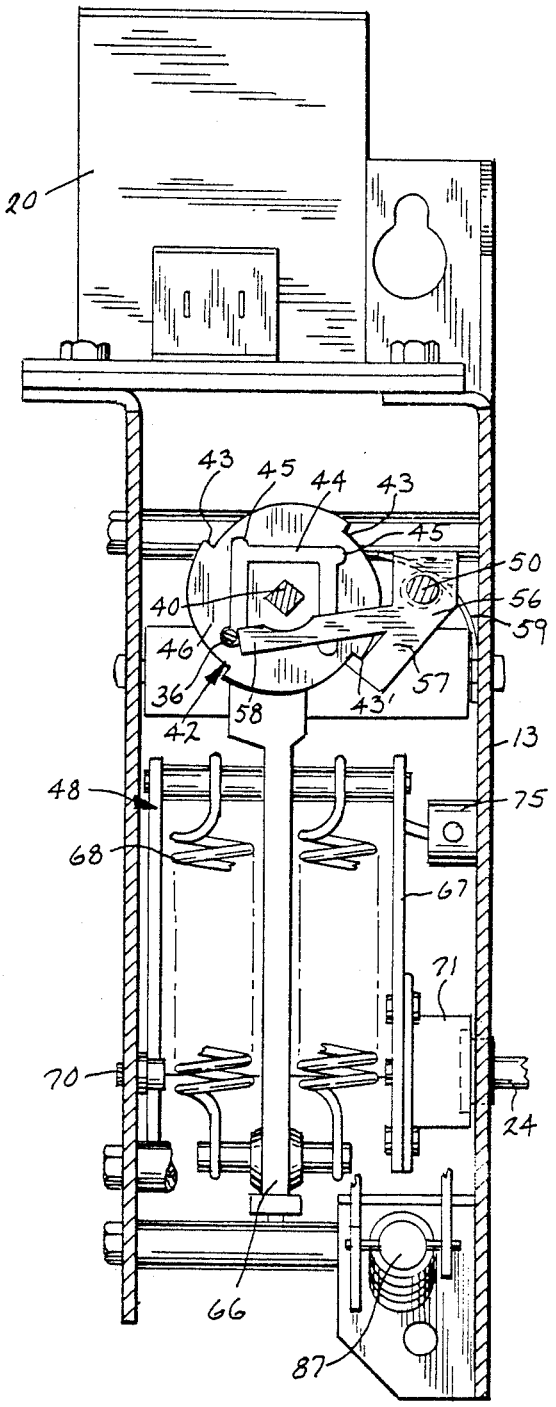
FIG. 4 is a cross section of the actuator assembly taking along lines 4—4 of FIG. 2.

The internal mechanism of the actuator assembly 11 is illustrated in FIGS. 2 and 3 from the left side and front respectively. A first drive shaft 40 has a square cross section and extends between the front cover 13 and a rear cover 19 of the actuator assembly 11. Mounted on the first drive shaft 40 in a spaced relationship are two ratchet wheels 41 and 42. As shown in FIGS. 3 and 4, each ratchet wheel 41 and 42 has four teeth 43 on its circumferential surface. The teeth 43 on the first ratchet wheel 41 are cut in the opposite direction to the teeth 43 on the second ratchet wheel 42. A square groove 44 having notches 45 at each corner is cut into the inward facing major circular surface 46 of each ratchet wheel 41 and 42.

Referring to FIGS. 2 and 4, the primary solenoid 20 includes an electrical coil schematically designated as element 30, encircling a plunger 32 which moves within the coil 30 along its vertical longitudinal axis. A pawl mechanism 34 is attached to the remote end of the plunger 32. The pawl mechanism 34 includes a pin 36 extending from each side thereof into the square grooves 44 of the two ratchet wheels 41 and 42. As the plunger 32 is drawn upward by the activation of the solenoid 30, the pawl pin 36 engages the notches 45 at the corners of the square grooves 44 causing each of the ratchet wheels 41 and 42 to rotate. This action produces a clockwise rotation of the first drive shaft 40 as viewed from the front of the transfer switch 10. The pawl pin 36 is spring loaded to follow the outer edge of the grooves 44 as the plunger 32 falls downward when the solenoid is deactivated. At the bottom of the plunger's stroke the pin 36 is located in the next notch 45 of groove 44.

With reference to FIGS. 2 and 3 the manual operator handle 14 is connected to the end of a second drive shaft 50 which extends parallel to the first drive shaft 40. A manual activator lever 52 is attached to the second drive shaft and extends therefrom. The manual activator lever 52 has a semicircular ring shape so that when it is rotated in a clockwise direction by movement of the handle 14 and the second drive shaft 50, it will extend around the first drive shaft 40 contacting the underside of the pawl mechanism 34 pushing it upward. This action produces movement similar to that when the primary solenoid 20 is activated. Therefore, either the activation of the primary solenoid 20 or the rotation of the manual operator handle 14, produces a rotation of the first drive shaft 40. The manual activator lever 52 is coupled by a linkage (not shown) to the normally closed switch 22 at the top of the activator assembly 11 shown in FIG. 1. When the manual lever is moved a slight amount to activate the automatic transfer switch mechanism, the indicator switch 22 opens disconnecting the primary solenoid 20 from the control circuitry. This action prevents this solenoid 20 from being energized while the automatic transfer switch 10 is being manually operated.

A first latch 54 is mounted on the second drive shaft 50 in a manner which allows the drive shaft to rotate without producing movement of the first latch. A torsion spring 55 is positioned around the second shaft 50 with its ends contacting the first latch 54 and the front cover 13 to bias the first latch against the first ratchet wheel 41. Each movement of the pawl mechanism, either as a result of activation of the primary solenoid 20 or the manual operator handle 14, produces a 90 degree clockwise rotation of the ratchet wheels 41 and 42 and the first drive shaft 40. The first latch 54 prevents the first ratchet wheel 41 and therefore the first drive shaft 40 from rotating in the counterclockwise direction once the activation force has been removed.

FIG. 4 shows a second latch 56 located on the second drive shaft 50 in a manner that allows it to rotate freely about the shaft. The second latch 56 has a short first arm 57 with a tab biased against the circumferential surface of the second ratchet wheel 42. The bias force is provided by a second torsion spring 59 on the second drive shaft 50 behind the second latch. The short first arm 57 engages the detent teeth 43 to prevent the second ratchet wheel 42 and thereby the first drive shaft 40 from rotating more than 90 degrees for each activation by either the solenoid 20 or the manual operator lever 14. The second latch 56 also has a longer second arm 58 which extends under the first drive shaft 40. The distal end of the second latch arm 58 is pushed downward by the pawl mechanism 34 when the solenoid is in the deactivated state. When the pawl mechanism 34 presses against the second arm 58, the second latch 56 is rotated so that its first arm 57 moves away from contact with the second ratchet wheel 42. When the pawl mechanism 34 is activated again causing a rotation of the second ratchet wheel 42, the ratchet wheel will rotate a slight amount before the short arm 57 of the second latch 56 once again engages the circumferential surface of the wheel. This permits the tooth 43' to rotate past the end of the first arm 57 allowing another 90 degrees of rotation of the ratchet wheel 42 to occur.

The ratchet mechanism consisting of pawl 34 and the two ratchet wheels 41 and 42 provide a mechanism by which the linear motion from the solenoid 20 imparts a rotational movement onto the first drive shaft 40 so as to rotate the two cams 61 and 62. With each activation of the solenoid, the ratchet wheels 41 and 42 due to their square notched grooves 44, impart a 90 degree rotation to the first drive shaft 40. By mounting the manual handle 40 on a separate second drive shaft 50 and providing the manual activation lever 52 to couple the rotation of the second drive shaft 50 to the pawl 34, the movement of the first drive shaft 40 is isolated from the handle 14. As a result, when the solenoid 20 is employed to activate the automatic transfer switch 10, its induced rotation of the first drive shaft 40 does not produce a movement of the handle 14. Therefore, should a human operator's hand be in the vicinity of the handle 14 when the solenoid is activated, the handle remains stationary and does not strike the operator's hand.

Figure 7:
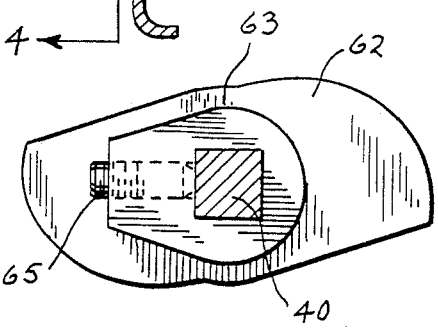
FIG. 7 is a plane view of a cam in the actuator mechanism.

Referring to FIG. 2, two elongated cams 61 and 62 are attached to the first drive shaft 40 spaced from the second ratchet wheel 42. The first cam 61 is rotated 90 degrees about the first drive shaft 40 from the orientation of the second cam 62. The second cam 62 is illustrated in FIG. 7. One side of the cam has a tubular projection 63 through which the first drive shaft 40 passes. A set screw 65 in an aperture of the projection 63 fastens the second cam 62 to the first drive shaft 40. The first cam 61 has a profile identical to that of the second cam 61, however the tubular projection 63' is on the reverse side of the first cam 61 as shown in FIG. 2.

The first and second cams 61 and 62 engage an over-the-center spring mechanism 48. An over-the-center spring mechanism is generically a mechanical assembly having a rotatable member which pivots through an arc. A spring biases the rotatable member toward one or the other ends of the arc, depending upon which side of the center point of the arc the rotatable member is positioned. A driving apparatus forces the rotatable member past the center point against the bias of the spring. Once past the center point, the spring causes continued movement of the rotatable member away from the center point. In the present switch, the over-the-center spring mechanism 48 comprises a drive lever 66, an index cam 67, and two springs 68 as shown in FIG. 2 and 3. The drive lever 66 is mounted on a shaft 64 that extends between the side walls of the actuator mechanism 11. The drive lever 66 has two cam rollers 69 and 69' which ride on the first and second cams 61 and 62, respectively and act as cam followers. As the cams rotate, driven by the first drive shaft 40, they cause the drive lever 66 to pivot about its shaft 64 from a first position shown in FIG. 2 to a second position shown in FIG. 6. The action of the two cams 61 and 62 forces the lower end of the drive lever 66 against one of the two internal support rods 72 of the actuator assembly 11 depending upon the extreme position of the drive lever 66. The lower end of the drive lever 66 has a spring retaining pin 77 extending therethrough to which one end of the two springs 68 attach.

The index cam 67 is formed by two parallel plates 78 and 79 on opposite sides of the drive lever 66. The two plates 78 and 79 are joined by a bridge member 89. The second plate 79 of the index cam 67 is connected by coupling 71 (FIG. 4) to the switch drive shaft 24. The first plate 78 is connected by a pivot 70 to the left side wall 60 of the actuator assembly 11. This pivot 70 is aligned with the switch drive shaft 24 on the other side of the assembly. A drive link 15 is connected by a pin to the lower end of the first plate 78 and extends to the position indicator 16 (FIG. 1). A spring rod 98 extends between the upper edges of the two index cam plates 78 and 79 and has the other end of each spring 68 attached to it. The spring rod 98 extends through a large aperture 99 in the drive lever 66 which allows the rod to move unencumbered as the mechanism operates. The second plate 79 has a cam edge 80 with an elongated notch 81 cut therein.

Figure 6:
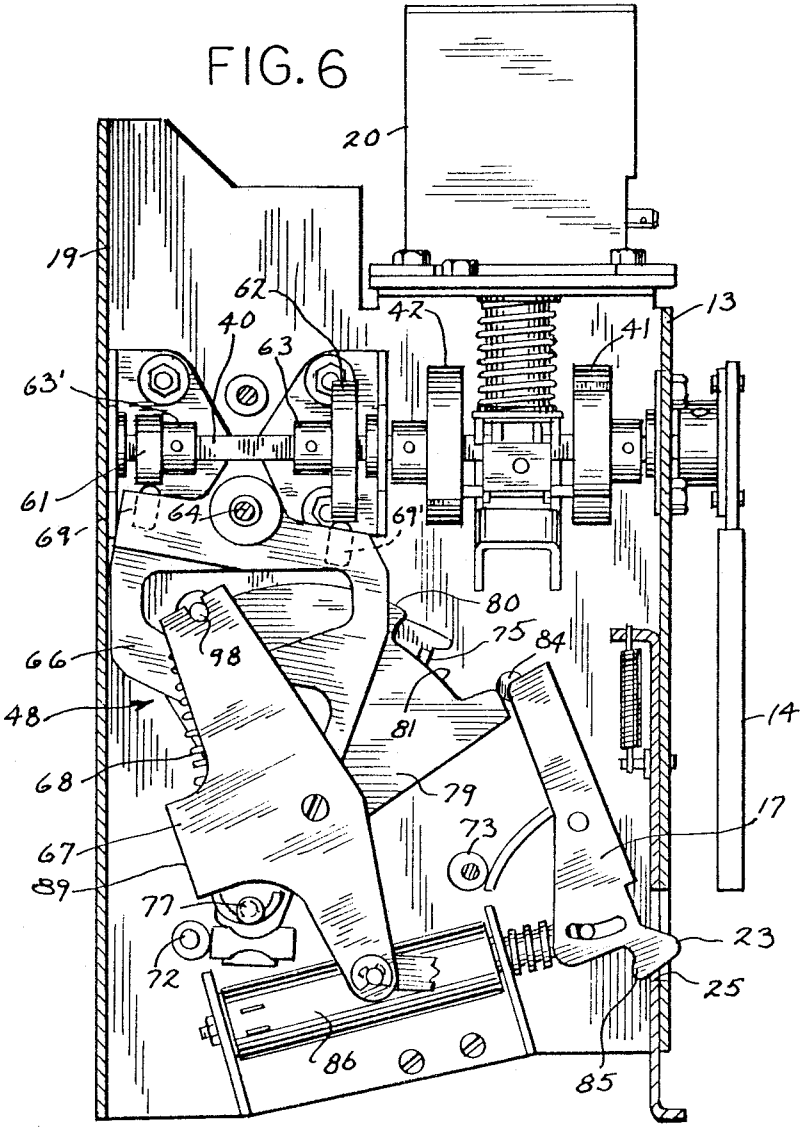
FIGS. 5 and 6 are side views of the actuator mechanism in two different positions from that shown in FIG. 2.

As the lever 66 pivots from one extreme position to the other, the tension exerted by springs 68 on the index cam 67 cause the latter element to rotate about the pivot 70 so that the index cam assumes two extreme positions of rotation illustrated in FIG. 2 and 6. The index cam plate 79 has a tab 74 extending from its rear surface as shown in FIGS. 3 and 4. This tab 74 strikes one of two bumpers 75 and 76 located on the right sidewall 60 in the two extreme positions of the index cam's movement.

As illustrated in FIG. 4, the index cam 67 is connected by coupling 71 to the switch drive shaft 24 to produce a rotation of the switch drive shaft as the index cam pivots. When the over-the-center spring mechanism 48 is in the position shown in FIG. 2, the switch drive shaft 24 places the switch in each module 12 into the position illustrated in FIG. 8. The movable contact arm 90 of each switch module 12 abuts the second fixed contact 95 when the over-the-center spring mechanism 48 is in the position shown in FIG. 6.

A center-off latch lever 17, illustrated in FIG. 2, pivots about a pivot shaft 83. One end of the latch lever 17 has a roller 84 attached thereto which rides along the curved edge 80 of the second index cam plate 79. A torsion spring is positioned on the latch lever pivot shaft 83 to bias the latch lever roller 84 against the index cam 67. The end of the latch lever 17 remote from the roller 84 has an elongated slot 82 cut therein. A secondary solenoid 68 is positioned on the right side wall 60 near its bottom edge. The secondary solenoid 86 has a plunger 87 with a drive pin 88 that is located within the elongated slot 82. When the secondary solenoid 86 is energized by the control circuit, the plunger 87 is drawn inward causing pin 88 to pull the center-off latch lever 17 away from contact with the index cam 67. Similarly, pushing on the end portion 23 of the latch lever 17 that extends through the aperture in the front cover 13 will cause a similar disengagement of the latch lever from the index cam.

The end portion 23 of the latch lever 17 also extends through an aperture 25 in the lock lever 18. In the position of the latch lever 17 shown in FIG. 5, a catch 85 of the end portion 23 is outside of the lock lever 18. If the lock lever 18 is raised upward, the lower edge of the aperture 25 will engage the catch 85 so that the latch lever cannot be disengaged from the notch 81 of the index cam 67. As a result, the index cam 87 is prevented from moving into one of its two extreme positions wherein the switches within modules 12 are in either the emergency or the normal contact positions. As noted previously, the lock lever 18 may be held in this position by placing a padlock through the elongated horizontal slots in the front cover 13 and the lock lever 18.

The over-the-center spring mechanism 48, comprising drive lever 66, index cam 67, and the two springs 68, provides a toggle type mechanism which alternately forces the contacts within the switch modules 12 into one of the closed states connecting the load either to the normal or emergency electricity supplies. Referring to FIGS. 3 and 6, the automatic transfer switch 10 is activated either by energizing the solenoid 20 or by rotating the manual operator handle 14 in a clockwise direction. This activation imparts a rotational force onto the first drive shaft 40 via the ratchet assembly consisting of pawl 34 and the ratchet wheels 41 and 42. As the first drive shaft 40 rotates, the second cam 62 no longer is in contact with its roller 69' on the drive lever 66 and the first cam 61 makes contact with its drive lever roller. As the shaft 40 continues to rotate, the first cam 61 forces its side of the drive lever 66 downward causing the drive lever to pivot counter clockwise about its shaft 64. As the drive lever 66 continues to rotate, the springs 68 travel to an unstable center position with respect to the index cam 67. The force from the first cam 61 is sufficient to move the drive lever 66 past the center position stretching the two springs 68 in doing so.

Figure 5:
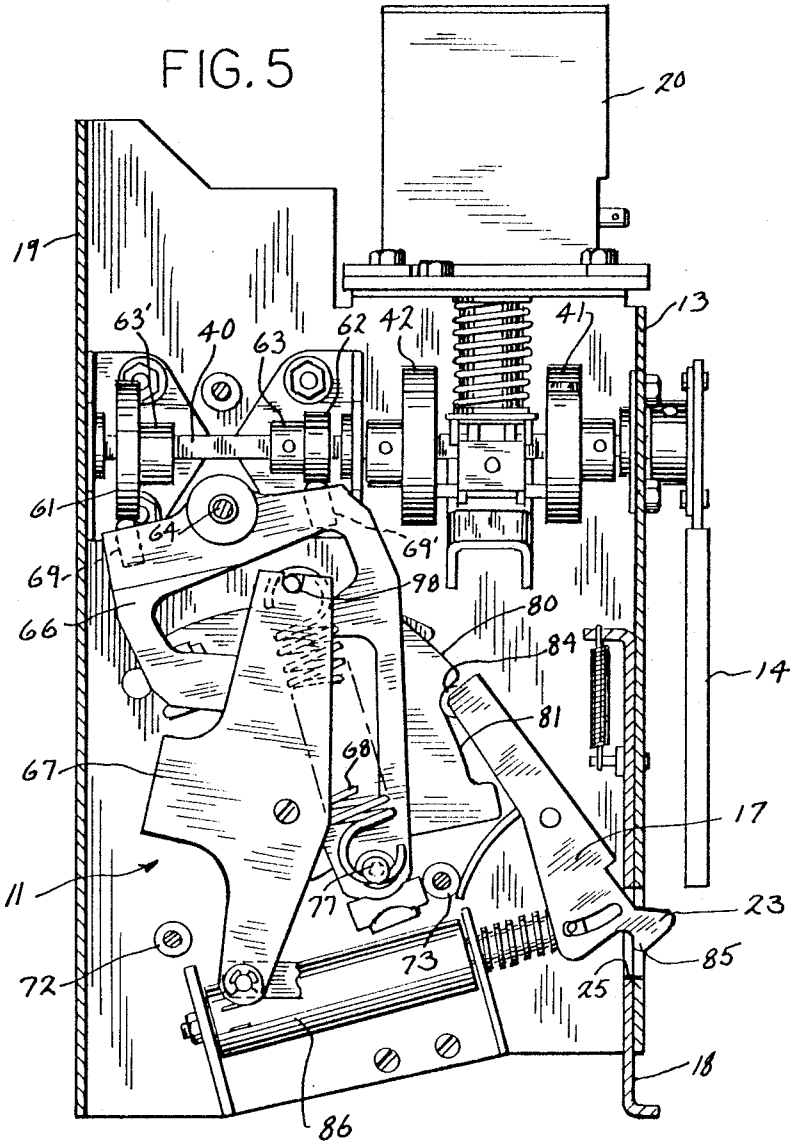

Once the drive lever 66 has traveled past the unstable center position, the springs 68 begin to contract rotating the index cam 67 clockwise until it travels to the intermediate position illustrated in FIG. 5. The contraction of the springs 68 continues the movement of the index cam even without additional force being applied by the first cam 61. As the index cam 67 was rotated clockwise, the centeroff latch lever 17 followed the curved edge 80 of the second plate 79. The torsion spring of the latch lever 17 causes the roller 84 to fall into the notch 81 as the second index cam plate 79 rotates. The over-the-center spring force causes the index cam 67 to continue to rotate clockwise until the roller 84 of the cam abuts the upper edge of the notch 81. Because of the sharp angle of the upper edge, further rotation of the index cam 67 into the full clockwise position is inhibited by the latch lever 17. The notch 81 acts as a stop to halt the full rotation of the index cam 67.

When the actuator mechanism was in the initial position illustrated in FIG. 6, the contact arm 90 of each switch module shown in FIG. 8 was against the second fixed contact 95. The rotation of the index cam 67 of the over-the-center spring mechanism 48 produced a corresponding rotation of the switch drive shaft 24 which rotated each contact arm 90 away from the second fixed contact 95. However, at the point where the latch lever 17 halted the rotation, the index cam 67 and the switch drive shaft 24 have not rotated enough to bring the contact arm 90 into abutment with the first fixed contact 93. Therefore, in the position illustrated in FIG. 5, when the index cam latch lever 17 is engaging the notch 81, the switch modules 12 are in a center-off state at which the load switched by the modules 12 is not connected to either source of electricity.

In order to complete the transfer action of the switch 10, the latch lever 17 must be pivoted out of the notch 81. This is accomplished by either energizing the secondary solenoid 87 or by an operator pressing on the end portion 23 of the latch lever 17 that extends through the aperature in the front cover 13. Once the roller 84 of the latch lever 17 has been retracted from the notch 81, the force provided by the springs 68 will cause the index cam 67 to continue its clockwise rotation into a position illustrated in FIG. 2. The primary solenoid 20 does not have to be energized to produce this continued movement. At this final position, the index cam 67 has rotated the switch drive shaft 24 into its other extreme position at which the switch module contact arm 90 is abutting the first fixed contact 93.

From the position in FIG. 2, if the primary solenoid 20 or the manual operator level 14 is again activated to produce another rotation of the first drive shaft 40, the first cam 61 is rotated away from contact with its cam roller 69 and the second cam 62 is rotated into contact with its cam roller 69'. This action pivots the drive lever 66 in a clockwise direction past the unstable center spring position, reversing the rotation of the index cam 66 toward the position illustrated in FIG. 6. However, once the over-the-center spring mechanism 48 was past the unstable center position, the roller 84 of the index cam latch lever 17 again drops into the notch 81. The counterclockwise rotation of the index cam 67 continues until the latch roller 84 abuts the lower edge of the notch 81. In this position the latch lever 17 halts the rotation of the index cam 67 so that the switch module drive shaft 24 positions the switch module contact arm 90 in the center-off position at which the load is connected to neither electricity source. Once again, if the center-off latch lever 17 is pivoted out of the notch 81, the index cam 67 will continue its counterclockwise rotation coming to rest at the position illustrated in FIG. 6.

Referring again to FIG. 5 where the actuator assembly 11 is in the center-off position, if either the solenoid 20 or the manual operator handle 14 is activated, the index cam 67 will be prevented from traveling into the final position illustrated in FIG. 2, but will reverse its direction rotating counterclockwise until the roller 84 of the centeroff latch lever 17 abuts the lower edge of the notch 81. In this position the center-off mechanism is now biased toward the first switch closure position and pivoting of the latch lever 17 out of the notch 81 will cause the over-the-center switch mechanism 48 to return to the position illustrated in FIG. 6.

The present invention provides a switch actuator mechanism with an over-the-center spring mechanism 48 having a center-off position at which the actuator assembly is biased toward one of the extreme positions where a set of contacts of the switch will be closed. However, reenergizing the drive mechanism for the actuator assembly will reverse the bias of the over-the-center spring mechanism 48 toward the other closure position. The secondary solenoid 86 may be energized simultaneously with the primary solenoid 20 so that the latch lever 17 is fully pivoted during the rotation of the over-the-center spring mechanism. In this instance, the actuator assembly travels from one extreme position to the other extreme position illustrated in FIGS. 2 and 6 without pausing in the center-off position.

We claim:

1. A transfer switch comprising:

a means for alternatively connecting an electric load to one of two sources of electricity;

an over-the-center spring mechanism operatively coupled to said connecting means, said spring mechanism having a first position at which the load is connected to one of the sources of electricity, a second position at which the load is connected to the other source, and an intermediate position between the first and second positions;

means for driving the over-the-center spring mechanism from the first and second positions past the intermediate position;

means for halting the movement of the over-the-center spring mechanism during its movement between the first and second positions in a position at which the load is not connected to either source of electricity.

2. The switch as recited in claim 1 wherein said over-the-center spring mechanism comprises:

a lever which becomes engaged by said means for driving;

an index cam operatively coupled to said connecting means;

a spring connected between said lever and said index cam so that movement of said lever will impart rotational movement to said index cam.

3. The switch as recited in claim 2 wherein said lever includes a cam follower; and said driving means includes:

a first shaft having a cam which engages the cam follower, and having a ratchet wheel; and a pawl assembly for driving said ratchet wheel.

4. The switch as recited in claim 3 wherein said driving means further includes a first solenoid connected to said pawl.

5. The switch as recited in claim 4 wherein said driving means further includes:

a second shaft;

a handle coupled to said second shaft for rotating said second shaft;

means for coupling said second shaft to said pawl to cause said pawl to drive said ratchet wheel.

6. The switch as recited in claim 3 wherein said driving means further includes:

a second shaft;

a handle coupled to said second shaft for rotating said second shaft;

means for coupling said second shaft to said pawl to cause said pawl to drive said ratchet wheel.

7. The switch as recited in claim 1 further including means for releasing said halting means to permit the over-the-center spring mechanism to continue its movement between the first and second positions.

8. The switch as recited in claim 1 wherein said halting means comprises:

a spring loaded lever which engages a stop means on the over-the-center spring mechanism; and a second solenoid for releasing said spring loaded lever from engaging the stop means.

9. A transfer switch comprising:

a means for alternately connecting an electric load to two sources of electricity;

an over-the-center spring mechanism operatively coupled to said connecting means, said spring mechanism having a first position at which the load is connected to one of the sources and a second position at which the load is connected to the other source;

a shaft having a cam which engages the spring mechanism to drive it between the first and second positions, and having a ratchet wheel attached thereto;

a pawl for rotating the ratchet wheel and said shaft; and means for driving said pawl.

10. The switch as recited in claim 9 wherein said means for driving said pawl includes a solenoid.

11. The switch as recited in claim 9 wherein said means for driving said pawl includes:

a second shaft;

a handle coupled to said second shaft;

a lever coupled to said second shaft to engage said pawl upon rotation of said second shaft.

12. The switch as recited in claim 11 wherein said means for driving said pawl also includes a solenoid.

13. The switch as recited in claim 9 further includes means for releasably engaging the spring mechanism to halt the movement of the mechanism at a third position at which the load is not connected to either source of electricity.

14. A switch comprising:

a means for alternately connecting an electric load to two sources of electricity;

an over-the-center spring mechanism operatively coupled to said connecting means, said spring mechanism having a first position at which the load is connected to one of the sources and a second position at which the load is connected to the other source; and means for driving the over-the-center spring mechanism alternatively toward each of the first and second positions, including a solenoid and a manually operable handle assembly.

* * * * *